United States Patent [19]

Lamond

[11] Patent Number: 4,516,278

[45] Date of Patent: May 14, 1985

[54] FLEXIBLE PLUMBING TRAP

[76] Inventor: Lee T. Lamond, 613 Shearer St., North Wales, Pa. 19454

[21] Appl. No.: 200,954

[22] Filed: Oct. 27, 1980

Related U.S. Application Data

[63] Continuation-in-part of Ser. No. 126,546, Mar. 3, 1980, abandoned.

[51] Int. Cl.[3] ..... E03C 1/00; F16K 9/00

[52] U.S. Cl. ..... 4/191; 4/DIG. 13; 4/DIG. 16; 285/387; 137/247.41

[58] Field of Search ..... 4/191, 207, DIG. 7, 4/DIG. 13, DIG. 16, 197; 285/169, 174, 176, 387, 388, DIG. 22; 137/247.41-247.51

[56] References Cited

U.S. PATENT DOCUMENTS

| | | | |
|---|---|---|---|
| 178,059 | 5/1876 | Hutchins | 4/DIG. 13 |
| 1,217,763 | 2/1917 | Hirrish | 4/DIG. 14 |
| 1,450,606 | 4/1923 | Paine | 285/388 X |
| 2,192,962 | 3/1940 | Dalzell | 285/387 |
| 2,353,012 | 7/1944 | Cheney | 285/387 |
| 2,484,031 | 6/1944 | Havrenius | 4/DIG. 13 |
| 2,736,577 | 2/1956 | Mackey | 285/354 X |
| 2,935,992 | 5/1956 | Barker | 137/247.11 |
| 2,959,430 | 11/1960 | Haslam | 285/354 X |
| 3,313,314 | 5/1964 | Burke et al. | 137/247.27 |
| 3,719,209 | 9/1970 | Rush et al. | 138/177 |
| 3,860,978 | 5/1973 | Wirth | 4/207 |
| 3,908,208 | 5/1973 | McIlroy | 4/207 |
| 3,967,324 | 5/1975 | Olive | 4/207 |
| 4,081,190 | 3/1976 | Itzler | 285/226 |

FOREIGN PATENT DOCUMENTS

| | | | |
|---|---|---|---|
| 1409730 | 4/1969 | Fed. Rep. of Germany | 4/DIG. 16 |

*Primary Examiner*—Charles E. Phillips

*Attorney, Agent, or Firm*—Z. T. Wobensmith, III

[57] ABSTRACT

A plumbing trap is described for use with drain pipes from sinks or other fixtures that fits pipe of different diameters, which drain pipes need not be in perfect alignment, and may be of a different diameter at the entrance than at the exit of the trap. The trap can be easily attached and detached, is molded of a flexible plastic which provides a soft structure that can be manually manipulated to discharge obstructions therefrom without removal from the drain pipes, and is impervious to most chemicals.

15 Claims, 8 Drawing Figures

FLEXIBLE PLUMBING TRAP

CROSS REFERENCE TO RELATED APPLICATION

This application is a continuation in part of my prior application Ser. No. 126,546, filed Mar. 3, 1980.

BACKGROUND OF THE INVENTION

1. Field of the Invention

A plumbing trap is provided of the type that is easily attached and detached, flexible to provide for obstruction removal without disconnection and is easily adaptable to fit pipes of various types and diameters.

2. Description of the Prior Art

A plumbing trap that is easy to service without the necessity of dismantling it from the attached drain pipes has long been the goal of many inventors. Until my invention no trap was provided that was usable with pipes of different sizes and types, was easy to dislodge obstructions from, and was simple enough so that the average homeowner could install and remove it without the use of special tools.

One example of previously available traps is shown in the U.S. Pat. No. 178,059 to Hutchins, which is a trap of conventional shape, made of india rubber to prevent bursting from freezing, and which appears to be of tubing that slips on the pipes at each end but which has no provisions for secure attachment, and is not adaptable to different diameters of pipes.

The patent to Havrenius, U.S. Pat. No. 2,484,031 shows a drain trap of rubber with an internal partition forming an S-type of trap, with the ends of the trap containing ridges which grip the drain pipes over which they extend. The Havrenius structure requires the entrance and exit pipes to be in close vertical alignment, would not be useful otherwise, and has no provisions for manual manipulation for obstruction removal.

The U.S. Pat. No. 2,935,992 to Barker et al., illustrates a flexible trap of ball like configuration with internal partitions requiring vertical alignment of the pipes and is not useful in other dispositions.

The U.S. Pat. No. 3,313,314 to Burke et al., shows a flexible drain for sinks, of a modified S-bend shape, which is shown as attached to pipes from two sinks, and connected to one outlet, by slipping it over the pipes and is retained by radiator hose type clamps. The Burke structure requires fairly preceise vertical pipe alignment and is not suitable for other applications.

The U.S. Pat. No. 3,860,978 to Wirth, shows a trap composed of a length of flexible hose, with a removable clamp for maintaining the hose in a U-shape, with male and female end fittings for connections to pipes from a sink and to an outlet pipe connected to a sewer or septic system.

The U.S. Pat. No. 3,719,209 to Rush et al., shows arcuate tubular articles of rigid plastic which can include plumbing traps, requires precise pipe alignment and cannot be compressed to dislodge particles therein.

The U.S. Pat. No. 3,908,208 to McIlroy illustrates a quick release safety trap which is fabricated from a deflectable type of plastic material which is connected at the ends by resilient clamps. The trap is composed of transparent high density polyethylene, cannot be squeezed to dislodge obstructions, is not suitable for connection to many types of drain pipes and cannot be used with pipes of different diameters.

The U.S. Pat. No. 3,967,324 to Olive, illustrates a flexible trap for a waste line assembly to be used with a toilet. The trap cannot be squeezed to dislodge obstructions, and is not suitable for use with pipes of different diameters or with sink drain pipes.

The U.S. Pat. No. 4,081,190 to Itzler illustrates a plumbing device for connecting a sink tailpiece to an out-of-alignment trap. The device has straight rigid end portions and a flexible pleated section therebetween all constructed of blowmolded polyethylene. The Itzler device cannot be squeezed, does not operate as a trap, and does not fit pipes of different diameters.

SUMMARY OF THE INVENTION

In accordance with the invention, a flexible plumbing trap is provided which is usable with different diameters and types of pipes, and is molded of a corrosive resistant plastic material, that can be manually manipulated to dislodge obstructions contained therein.

The principal object of the invention is to provide a flexible plumbing trap that can be easily manipulated to remove obstructions.

A further object of the invention is to provide a flexible plumbing trap that can be used with pipes that are not in precise alignment.

A further object of the invention is to provide a flexible plumbing trap that can be readily attached and detached by unskilled personnel.

A further object of the invention is to provide a flexible plumbing trap that can be used with different types of pipes.

A further object of the invention is to provide a flexible plumbing trap that can be used with pipe of different diameters at the entrance and the exit ends of the trap.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

DESCRIPTION OF THE PREFERRED EMBODIMENTS

Figure 1:
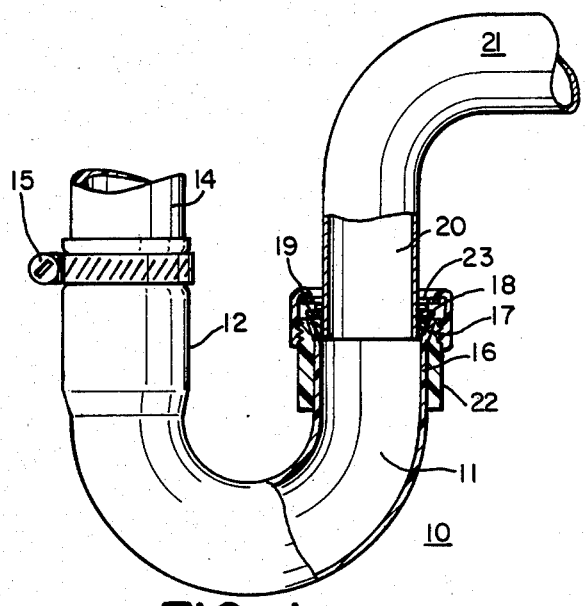
FIG. 1 is a side elevational view in partial section of one embodiment of the invention, connected to one and one half inch diameter metal drain pipes.
Figure 2:
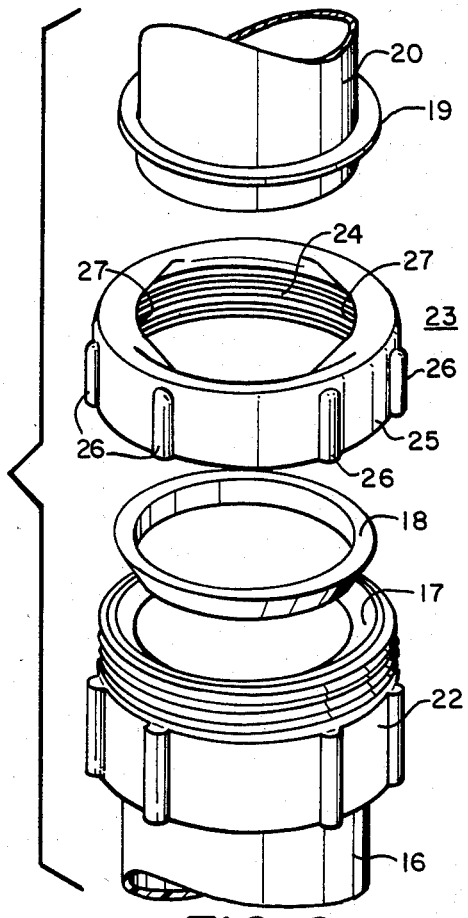
FIG. 2 is an exploded view, enlarged, of the embodiment of the invention as illustrated in FIG. 1.
Figure 3:
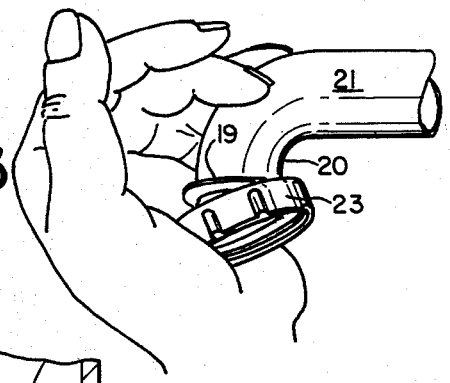
FIG. 3 is an elevational view illustrating the assembly of a portion of the trap to a one and one half inch diameter metal drain pipe.

Referring now more particularly to the drawings and FIGS. 1, 2 and 3 thereof, one embodiment of the flexible plumbing trap 10 is shown which includes an arcuate tubular hollow central body portion 11 with an end portion 12 of slightly larger diameter, at the left thereof, which as shown is connected to drain pipes 14 and 21 of one and one half inch diameter. The end portion 12 engaged with a straight piece of rigid drain pipe 14 is retained thereon by an adjustable clamp 15 of well known type similar to that used for the connection of automobile radiator hoses.

The body portion 11 at the right side thereof has a straight end piece 16 with a flared portion 17 engaged with a ferrule 18 of well known type which is engaged with a flat rim 19 on the straight end 20 of a piece of metal drain pipe 21 of one and one half inch diameter and which extends upwardly.

The flared portion 17 of end piece 16 is also engaged with a threaded outer rigid collar member 22 which has a collar nut 23 detachably engaged therewith squeezing the flared portion 17 between the member 22 and the ferrule 18 thereby forming a water-tight seal.

The collar nut 23 includes conventional internal threads 24 and an outer surface 25 with projections 26 for gripping by the installer. The nut 23 is open at the top with two opposed locking ears 27 that extend inwardly to engage the rim 19 of pipe 21 in installed position.

Figure 4:
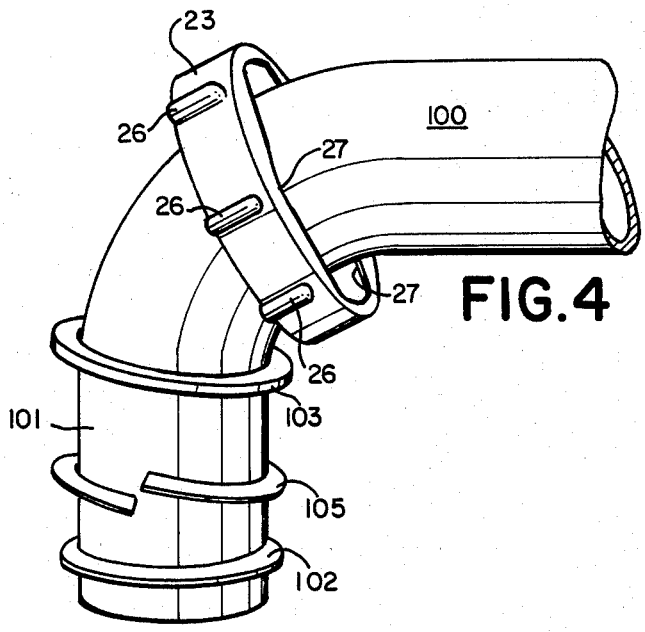
FIG. 4 is a side elevational view of a portion of the trap in partially assembled relation on a one and one quarter inch metal drain pipe.

Referring now to FIG. 4, a one and one quarter inch diameter metal drain pipe 100 is illustrated which has a straight portion 101 with a rim 102 thereon. A collar nut 23 is shown on the pipe 100 with a flat sealing washer 103 therebelow, which washer 103 is flexible to permit its passing over the rim 102. A flat brass washer 105 is provided with an inside diameter the same as the outside diameter of pipe 100 and split to permit it to pass over the rim 102.

Figure 5:
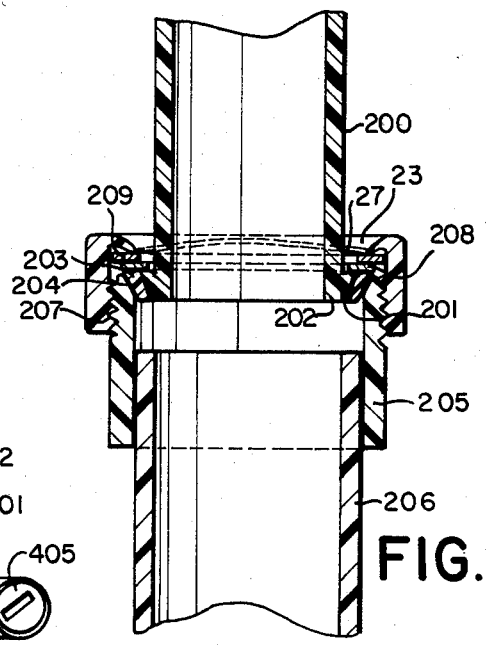
FIG. 5 is a side elevational sectional view of a portion of another embodiment of the invention connected to the end of a one and one quarter inch diameter rigid plastic drain pipe.

Referring now to FIG. 5, a straight portion of a one and one quarter inch drain pipe 200 is illustrated which may be formed of PVC plastic with a tapered rim 201 on its lower end 202. The rim 201 is engaged with a ferrule 203 which engages a flared portion 204 of collar member 205 to which a straight portion 206 of a flexible plumbing trap in accordance with the invention (not shown) is attached preferably by solvent welding. The collar member 205 is preferably formed of rigid polyvinylchloride plastic (PVC) with a threaded upper portion 207 which is engaged by a collar nut 23.

A flat metal washer 208 of approximately one and one-fourth inches inside diameter is provided which engages the rim 201 and has a flat plastic washer 209 of larger inside diameter engaged therewith and with the locking ears 27 of nut 23 retaining the pipe 200 to the collar member 205. The washer 208 is preferably formed of brass and the washer 209 preferably formed of PVC.

Figure 6:
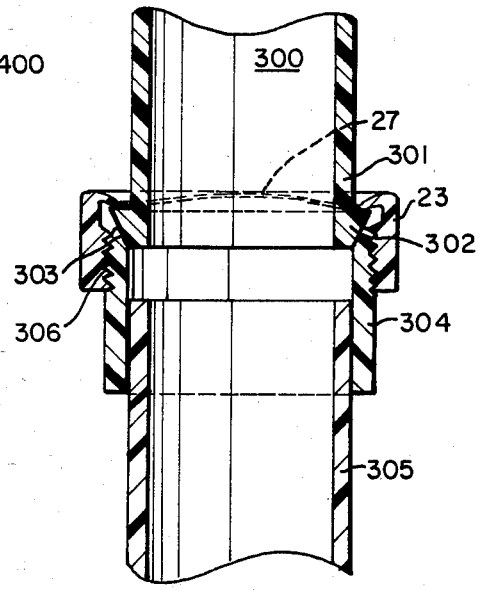
FIG. 6 is a side elevational sectional view illustrating a portion of another embodiment of the invention connected to a one and one half inch diameter rigid plastic drain pipe.

Referring now to FIG. 6, a one and one-half inch drain pipe 300 is illustrated with a straight end 301 which may be formed of rigid PVC and with a tapered end rim 302. The rim 302 is engaged with a flared portion 303 of an outer rigid collar member 304 to which a straight portion 305 of a flexible plumbing trap in accordance with the invention (not shown) is attached preferably by solvent welding. The collar member 304 is preferably formed of rigid PVC with a threaded outer upper portion 306 which is engaged by a collar nut 23 which has ears 27 that engage the rim 302 of pipe 300 thereby forming a water-tight seal between the rim 302 and collar member 304.

Figure 7:
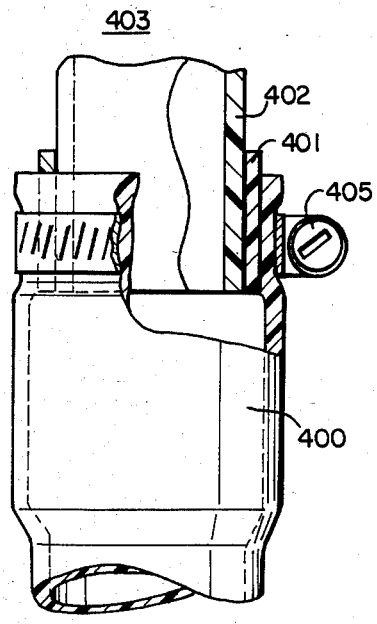
FIG. 7 is a side elevational sectional view of still another embodiment of the invention connected to a one and one quarter inch diameter rigid plastic drain pipe.

Referring now more particularly to FIG. 7, another embodiment of the invention is illustrated which includes the upper straight portion 400 from a flexible plumbing trap in accordance with the invention (not shown) which has a flexible plastic sleeve 401 between it and a straight portion 402 from a plastic drain pipe 403 of one and one-fourth inch diameter. The straight portion 400 is retained on the sleeve 401 and on the straight portion 402 by a hose clamp 405 of well known type making a water-tight seal therewith.

Figure 8:
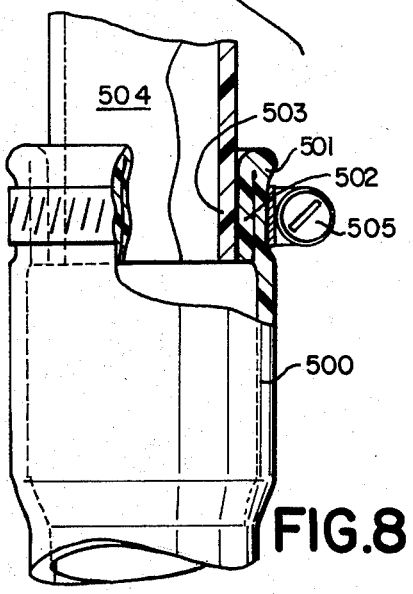
FIG. 8 is a side elevational view in partial section illustrating still another embodiment of the invention connected to a one and one quarter inch diameter rigid plastic drain pipe.

Referring now more particularly to FIG. 8, still another embodiment of the invention is illustrated, and which includes the upper portion 500 of a flexible plumbing trap in accordance with the invention (not shown) which includes a wall 501 of one-eighth inch thickness. An end portion 502 of wall 501 is pushed back inside itself and retained on the straight end portion 503 of a one and one-fourth inch diameter plastic drain pipe 504 by a clamp 505 of conventional type thereby forming a water-tight seal.

It should be noted that the locking ears 27 of collar nut 23 extend partially around the nut and are deformable to the extent that they can snap over rims both flat and tapered as found on drain pipes. An illustration of the assembly of the collar nut is depicted in FIG. 3 for a one and one-half inch metal drain pipe 21 but is assembled onto drain pipes with tapered ends in the same manner.

It will thus be seen that structures are provided with which the objects of the invention have been attained.

I claim:

1. A flexible plumbing trap for use with drain pipes from plumbing fixtures which drain pipes include one smooth straight drain pipe and one drain pipe with rim means on its end which trap comprises an arcuate tubular hollow central body portion, one end portion extending from said body portion and of different diameter than said body portion for engagement with said smooth straight drain pipe, adjustable clamp means for detachably connecting said one end portion of said trap to said smooth straight drain pipe, an other end portion of said trap extending from said body portion, a collar member engaged with the said other end portion of said trap and said drain pipe rim means end, a collar nut engaged with said rim means end of said drain pipe and said collar member, and said collar nut is deformable for movement over said rim means and has a pair of opposed locking ears which engage said rim means.

2. A flexible plumbing trap as defined in claim 1 in which said first mentioned end portion of said trap has an additional end portion of reduced diameter.

3. A flexible plumbing trap as defined in claim 1 in which said second mentioned end portion of said trap has a flared end.

4. A flexible plumbing trap as defined in claim 3 in which said flared end is in contact with the end of said drain pipe and said collar member.

5. A flexible plumbing trap as defined in claim 3 in which said flared end of said trap is solvent welded to said collar member.

6. A flexible plumbing trap as defined in claim 1 in which at least one of said drain pipes is formed of metal.

7. A flexible plumbing trap as defined in claim 1 in which said rim means is tapered.

8. A flexible plumbing trap as defined in claim 1 in which said pipe is of metal and said rim means is a flat rim, and a ferrule is provided on said pipe between said rim and said collar member.

9. A flexible plumbing trap as defined in claim 1 in which a flat sealing washer is provided on said drain pipe engaged by said ears of said collar nut, and a flat split washer is provided on said pipe engaged by said sealing washer and said rim means on said drain pipe.

10. A flexible plumbing trap as defined in claim 1 in which a flexible plastic sleeve is provided between said smooth straight drain pipe and said first mentioned end of said trap.

11. A flexible plumbing trap as defined in claim 1 in which said first mentioned end of said trap is doubled back on itself and engaged with said smooth straight drain pipe.

12. A flexible plumbing trap as defined in claim 1 in which at least one of said drain pipes is of rigid plastic.

13. A flexible plumbing trap as defined in claim 1 in which said trap is molded flexible synthetic plastic.

14. A flexible plumbing trap as defined in claim 1 in which said trap is of molded polyvinylchloride.

15. A flexible plumbing trap as defined in claim 1 in which at least one of said drain pipes is of rigid polyvinylchloride.

* * * * *

UNITED STATES PATENT AND TRADEMARK OFFICE

CERTIFICATE OF CORRECTION

PATENT NO. : 4,516,278

DATED : May 14, 1985

INVENTOR(S) : LEE T. LAMOND

It is certified that error appears in the above—identified patent and that said Letters Patent is hereby corrected as shown below:

Column 6,

Line 21, after "is", insert - of -.

Signed and Sealed this

*Third* Day of *September 1985*

[SEAL]

*Attest:*

DONALD J. QUIGG

*Attesting Officer* *Acting Commissioner of Patents and Trademarks - Designate*